United States Patent [19]

Kobayashi et al.

[11] 4,109,453

[45] Aug. 29, 1978

[54] FIBER SEPARATING DEVICE OF AN OPEN-END SPINNING APPARATUS

[75] Inventors: Akira Kobayashi, Obu; Kunji Chiba, Kariya; Noriaki Miyamoto, Kariya; Masao Shiraki, Kariya; Naotake Furukawa, Aichi, all of Japan

[73] Assignee: Kabushiki Kaisha Toyoda Jidoshokki Seisakusho, Japan

[21] Appl. No.: 789,029

[22] Filed: Apr. 20, 1977

[30] Foreign Application Priority Data

Apr. 26, 1976 [JP] Japan ..... 51-48327
May 6, 1976 [JP] Japan ..... 51-51522

[51] Int. Cl.[2] ..... D01H 1/12
[52] U.S. Cl. ..... 57/58.91; 19/105
[58] Field of Search ..... 57/58.89–58.95; 19/105

[56] References Cited

U.S. PATENT DOCUMENTS

| | | | |
|---|---|---|---|
| 3,571,859 | 3/1971 | Doudlebsky et al. | 57/58.91 X |
| 3,762,144 | 10/1973 | Didek et al. | 57/58.91 |
| 3,826,071 | 7/1974 | Grau | 57/58.91 X |
| 3,828,539 | 8/1974 | Croasdale et al. | 57/58.91 |
| 3,884,029 | 5/1975 | Ripka et al. | 57/58.91 |
| 3,938,310 | 2/1976 | Didek et al. | 57/58.91 |
| 3,988,881 | 11/1976 | Juillard et al. | 57/58.91 |
| 4,024,699 | 5/1977 | Goldammer | 57/58.91 |

FOREIGN PATENT DOCUMENTS

| | | | |
|---|---|---|---|
| 2,346,524 | 4/1974 | Fed. Rep. of Germany | 57/58.91 |
| 2,108,254 | 2/1971 | Fed. Rep. of Germany | 57/58.91 |
| 2,329,223 | 6/1973 | Fed. Rep. of Germany | 57/58.91 |

*Primary Examiner*—Donald Watkins
*Attorney, Agent, or Firm*—Burgess, Ryan and Wayne

[57] ABSTRACT

Disclosed is an open-end spinning apparatus provided with a fiber-bundle supply mechanism disposed to a casing and a combing roller disposed in the casing, so as to separate the supplied bundle of fibers into individual fibers, and a spinning rotor for forming a yarn from said individual fibers; a fiber carrying passage is formed in the casing at a position between the fiber-bundle supply mechanism and the spinning rotor, the fiber carrying passage being provided with a combing section where an action of the combing roller is imparted to the bundle of fibers delivered from the fiber-bundle supply mechanism so that the fibers of the fiber-bundle are separated from each other from; a pneumatic or mechanical means is provided for positively introducing the above-mentioned individual fibers to a part of the cylindrical surface of the combing roller; so that, consequently, all fibers contained in the bundle of fibers fed from the fiber-bundle supply mechanism receive effective combing action of the combing roller in the combing section of the fiber carrying passage.

10 Claims, 7 Drawing Figures

FIBER SEPARATING DEVICE OF AN OPEN-END SPINNING APPARATUS

SUMMARY OF THE INVENTION

The present invention relates to an improved fiber separating device for a conventional open-end spinning apparatus.

In the conventional open-end spinning apparatus comprising a fiber-bundle supplying mechanism and a combing roller which separates a bundle of fibers supplied from the fiber-bundle supply mechanism into individual fibers, and a spinning rotor which forms a yarn from individual fibers supplied from the combing roller, the fiber-bundle supply mechanism is provided with a feed roller and a presser which is always urged toward the feed roller by means of a spring, and a fiber carrying passage is formed at a cylindrically outside space adjacent to a cylindrical surface of the combing roller. In the carrying passage, there is provided with a combing section wherein the bundle of fibers is separated into individual fibers, a section for stripping individual fibers carried from the combing section from the combing roller, an intermediate section between the combing section and the stripping section, and a downstream opening connected to the entrance of the spinning rotor through which the free fibers carried from the stripping section are introduced into the spinning rotor. To strip the individual fibers from the combing roller effectively, an air supply conduit is connected to a part of the stripping section of the carrying passage in such a condition that an air stream is introduced into the stripping section from a tangential direction to the cylindrical surface of the combing roller so that the introduced air stream is effectively combined with an air stream introduced into the carrying passage at a position upstream of position where the two air streams are combined. The combined air stream is directed to the discharge opening with a higher speed than the speed of the above-mentioned air stream introduced in the carrying passage before the above-mentioned combination of air streams. Therefore, when a bundle of fibers is supplied to the fiber supply mechanism, the bundle of fibers is fed to the combing roller provided with combing wires under such condition that the bundle of fibers is gripped when it passes through the nip formed between the feed roller and the presser. Therefore, fibers separated from the above-mentioned nip, are individually separated from the bundle of fibers by the action of the combing wires of the combing roller in the combing section, and carried to the intermediate section of the carrying passage. In the intermediate section of the carrying passage, some of the individual fibers are carried by the combing wires of the combing roller and the other fibers are carried by the air stream introduced into carrying passage which has a carrying speed that is harmonized with the peripheral speed of the combing roller. When the fibers are carried to the stripping section, since the speed of the air stream in this section is remarkably higher than the peripheral speed of the combing roller, the fibers carried by the combing roller are pneumatically stripped from the combing wires of the combing roller and these fibers and the other fibers carried by the air stream in the intermediate section are carried to the downstream opening so that these fibers are introduced into the spinning rotor.

In the above-described conventional opening device, the quantity of the above-mentioned combined air stream is balanced with the quantity of the air which is capable of being discharged from the spinning rotor by means of the self-discharging capability thereof or by means of a suction created by a suction means connected to the spinning rotor. To prevent any possible damage of fibers by the severe action of the combing wires in the combing section, there is provided with such a radially expanded space with respect to the combing roller and this space is gradually made smaller toward the intermediate carrying section. Therefore, in this combing section, when fibers receive the action of the combing wire, these fibers are capable of escaping from the combing wire; therefore, any possible damage by the combing wire can be prevented. However, it is observed that in spite of the effective action of the combing wire to the fibers being positioned in the supplied bundle of fibers at the side of the combing roller, the fibers being positioned at the opposite side, can not receive effective action of the combing roller. Moreover, fibers carried by the air stream in the carrying passage tend to receive interference from the inside wall of the casing which disturbs the smooth carrying motion of fibers in the carrying passage. That is, these free fibers are subjected to a frictional action by the inside wall of the casing so that the free front end portions of these fibers are bent, or some of these fibers are combined in an entangled condition, and accordingly the smooth carrying motion of these free fibers is disturbed. Therefore, even if these free fibers are supplied into the spinning rotor together with the fibers stripped from the combing roller, since the supplied fibers include fibers having hooks or the above-mentioned combined entangled fibers, the yarn produced therefrom possibly involves such yarn defects as slubs, neps, distinguished variation of yarn thickness and, if the above-mentioned interference by the inside wall of the casing is substantial, the yarn formation in the spinning rotor is interrupted, in other words, the yarn is broken.

It must be further realized that, in the conventional open-end spinning apparatus, the length of the opening section in the carrying passage is so designed that this length is substantially identical to the average fiber length of the supplied bundle of fibers. Therefore, a greater length of the combing section is preferable if the fiber material has a long staple length. However, if the length of the opening section is extended, it is our opinion that the above-mentioned undesirable condition is remarkably enhanced.

Therefore, it is the principal object of the present invention to provide an improved fiber separating device of an open-end spinning apparatus having such characteristic functions that the separation of individual fibers from a supplied bundle of fibers can be effectively carried out and the carrying of the separated individual fibers from the combing section to the downstream opening of the carrying passage can be smoothly carried out without creation of hooks in the fibers and without creation of combined entangled fibers, so as to improve the yarn quality and also so as to prevent any possible yarn breakage due to the above-mentioned trouble, besides having the capability of being utilized for fiber material having long fiber length, and accordingly, the above-mentioned disadvantage of the conventional open-end spinning apparatus can be eliminated.

It is a further object of the present invention to provide an improved fiber separating device for an open-end spinning apparatus having a carrying passage for individual fibers separated from a bundle of fibers by means of a combing roller, whereby the effect of separation of the bundle of fibers into individual fibers can be enhanced without shortening the carrying passage.

To attain the purposes of the present invention, in the improved fiber-separating device according to the present invention, means for positively introducing separated individual fibers to the combing wires of the combing roller is provided in the above-mentioned combing section. Introducing means such as a mechanical introducing element for a pneumatic introducing means are practically utilized to attain the purpose of the present invention. In the case of utilizing a pneumatic introducing means, it is very important to carefully design such means so that they do not injure the stripping action of the fibers from the combing wire of the combing roller in the stripping section of the above-mentioned carrying passage.

DETAILED EXPLANATION OF THE INVENTION

Figure 1:
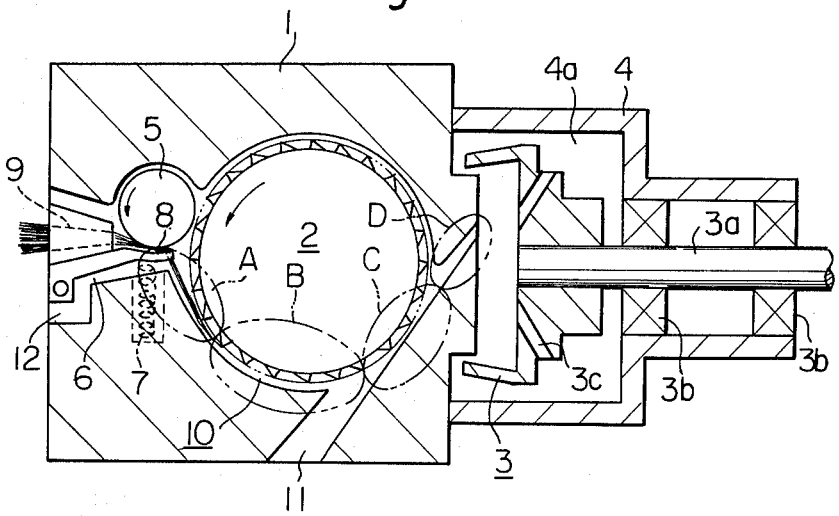
FIG. 1 is a schematic sectional view of a main part of the conventional open-end spinning apparatus.

To allow a better understanding the present invention, the construction of the main body of the conventional open-end spinning apparatus is hereinafter briefly explained. Referring to FIG. 1, the main part of the conventional open-end spinning apparatus comprises a fiber supply mechanism and a combing roller 2 covered with combing wires which separates a bundle of fibers into individual fibers, and a spinning rotor 3 which forms a yarn from the individually separated fibers. The fiber supply mechanism and the combing roller 2 are disposed in a casing 1 while the spinning rotor 3 is rotatably supported by a spinning rotor casing 4 which is detachably connected to the casing 1. The fiber supply mechanism comprises a feed roller 5 rotatably disposed in the casing 1 and a presser 6 pivotally disposed in the casing 1 in such a condition that the presser 6 is capable of turning toward the feed roller 5. A helical spring 7 mounted on the casing 1 always urges the presser 6 toward the feed roller so that a nip 8 is formed between the feed roller 5 and the presser 6. An entrance aperture 9 is formed in the casing 1 so as to allow feeding of a bundle of fibers to the abovementioned nip 8 between the feed roller 5 and the presser 6. Therefore, the entrance aperture 9 is hereinafter referred to as "a supply inlet." There is provided a substantially cylindrical space between the inside wall of the casing 1 and the combing roller 2, and a part of the cylindrical space starting from a position opened to the presser 6 and ending at a position connected to the spinning rotor 3 forms a fiber carrying passage 10. An air inlet 11 is connected to the passage 10 in the casing 1 in such a condition that it is possible to create an air stream tangentially directed to a part of the cylindrical surface of the combing roller 2. The above-mentioned opened section of the passage 10 is hereinafter referred to as a combing section A, the section where the air stream from the air inlet 11 works a part of the cylindrical surface of the combing cylinder 2 is referred to as a stripping section C, a section between the combing section A and the stripping section C is referred to as a carrying section and a section of the passage between the stripping section C and the spinning rotor 3 is referred to as a downstream opening D.

A further air inlet 12 is formed in the casing 1 at a position right below the presser 6 in such a condition that the inlet 12 opens into the upstream terminal of the combing section A of the passage 10. Therefore, the combined quantity of the air streams via the inlet 12 and the inlet 11 is maintained in a balanced condition with the quantity of air discharged from the spinning rotor 3.

In the above-mentioned construction, the combing roller 2 and the feed roller 5 are rotated toward the respective directions as shown by the arrows in FIG. 1 respectively. The spinning rotor 3 is provided with a rotating shaft 3*a* which is rotatably supported by a pair of bearings 3*b* disposed in the spinning rotor casing 4. The spinning rotor 3 is further provided with a plurality of apertures 3c connected to the inside chamber of the rotor 3 and the chamber 4a of the casing 4 wherein the main body of the spinning rotor 3 is turnably positioned.

In the above-mentioned construction of the main part of the conventional open-end spinning apparatus, when a bundle of fibers is fed to the nip 8 between the feed roller 5 and the presser 6 from the supply inlet 9, the bundle of fibers is separated into individual fibers by the action of the combing wires of the combing roller 2, and the thus created individual fibers are carried to the spinning rotor 3 as already explained.

However, in the above-mentioned conventional open-end spinning apparatus, the previously mentioned drawbacks exist. To eliminate the drawbacks observes in the conventional open-end spinning apparatus, in the present invention, an additional means for positively introducing the individual fibers to a part of the cylindrical surface of the combing roller 2 is provided in the combing section A of the carrying passage 10.

Figure 2:
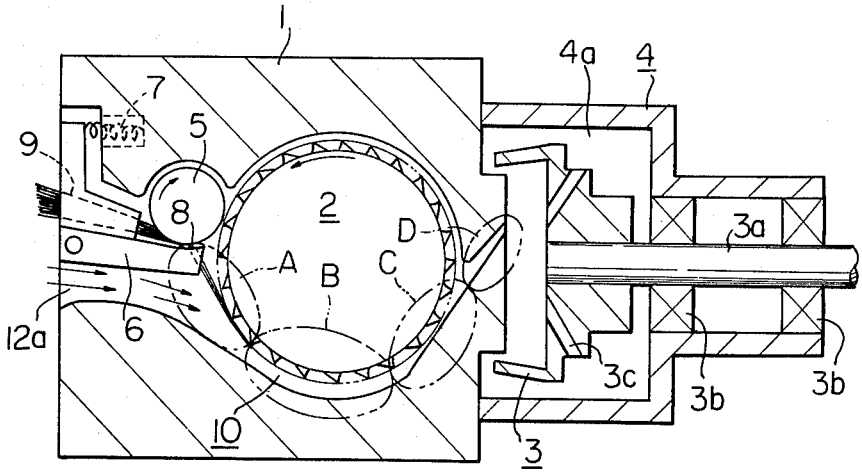
FIG. 2 is a schematic sectional view of a main part of the open-end spinning apparatus utilizing an improved fiber separating device according to the present invention.

One of the embodiments of this additional means is hereinafter explained in detail with reference to FIG. 2. In FIG. 2, the elements having the same function as those in the conventional open-end spinning apparatus described with reference to FIG. 1 are identified by identical reference numbers to those used in FIG. 1 and the explanation thereof is omitted. Therefore, only the improvement of the open-end spinning apparatus is explained here. In this embodiment, the radial space of the combing section A of the carrying passage 10 with respect to the combing roller 2 is expanded in such a condition that the cylindrical length of this combing section A is almost identical to the average staple length of the material fiber, and the inlet 12 is opened to the entire length of this combing section A, while the inlet 11 is omitted, as shown in FIG. 2. Therefore, the modified inlet is hereinafter referred to as a modified inlet 12*a*.

To effectively strip fibers from the combining wires of the combing roller 2 in the stripping section C, the space of the passage 10 in this section is gradually narrowed and then gradually expanded so that a strong air stream tangentially directed to the cylindrical surface of the combing roller 2 can be created at the most narrow position of the passage 10. In the above-mentioned embodiment of the present invention, when the bundle of fibers is fed to the nip 8 between the feed roller 3 and the presser 6, the bundle of fibers is supplied into the combing section A of the passage 10 in such condition that fibers still nipped by the nip 8 receive a combing action of the combing roller 2 so that any possible entaglement of fibers in the bundle of fibers is eliminated while individual fibers are strengthened.

When fibers F contained in the bundle of fibers leave the nip 8, these fibers F are introduced into the combing section A in a free condition, and are carried to the downstream of the passage 10 together with the air stream introduced from the modified inlet 12a. In the conventional open-end spinning apparatus, since the air stream from the inlet 12 is directed to the upstream terminal of the combing section A, and this air stream is not strong as is the air stream from the inlet 12a of the present embodiment, the individual fibers positioned at a side facing the combing wires of the combing roller 2 only receive the action of the combing roller while the other fibers are subjected to the friction of the inside wall of the casing 1 and, consequently, the troubles discussed above can not be prevented. However, in this embodiment of the present invention, since the air stream from the inlet 12a is directed to all of the combing cylinder 2 in the combing section A, the above-mentioned other fibers are forced to contact the combing wires of the combing cylinder 2 in the combing section A.

Therefore the desirable combing action can be applied to all fibers contained in the supplied bundle of fibers and accordingly, any of the possible troubles occuring in the carrying passage 10 of the conventional open-end spinning apparatus, which were discussed above, can be effectively avoided. As a result, the yarn quality can be improved very much and the number of yarn breakages during the spinning operation can be decreased. In addition to the above-mentioned advantages of the improvement, in the above-mentioned embodiment, it has been confirmed that, even if the length of the combing section A is extended so as to be the correct length for treating fibers having a long stable length, the above-mentioned advantages can be substantially maintained.

Figure 3:
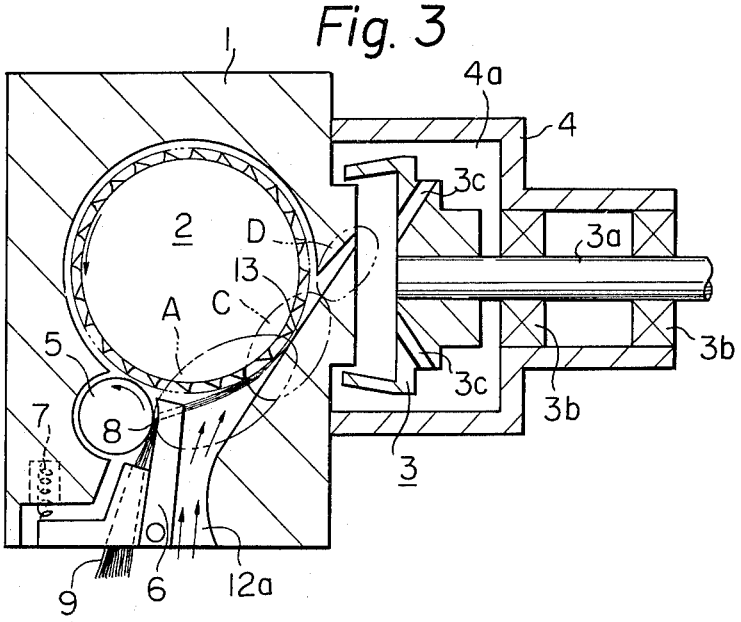
FIG. 3 is a schematic sectional view of a main part of the open-end spinning apparatus utilizing another improved fiber separating device according to the present invention.

In a modification of the apparatus shown in FIG. 2, that is, the apparatus shown in FIG. 3, the mechanism for supplying a bundle of fibers 9 and the air inlet 12*a* are disposed in the casing 1 at a position closer to the spinning rotor 3 than in the apparatus shown in FIG. 2. In this embodiment, the carrying section B of the apparatus shown in FIG. 2 is omitted. In other words, the fiber carrying passage 10 is only provided with the combing section A, the stripping section C and the downstream opening D. Further, the combing section A and the stripping section C overlap each other, as shown in FIG. 3, in such a condition that the distance between the nip 8 and a position 13, where the space between the combing roller 2 and the inside wall of the casing is minimized (hereinafter referred to as a stripping position), is almost identical to the average staple length of the material fiber.

Therefore, in this modified embodiment of the open-end spinning apparatus, since the fibers F receives the action of the combing cylinder 2 while the possible free movement thereof is controlled by the inside wall of the casing 1, very effective separating and straightening actions are imparted to the fibers. It should be noted that, since the intermediate carrying section B is omitted, creation of hooks in the fibers, or entanglement of fibers, which are a possibility if an intermediate carrying section having long distance exists, can be prevented. It should further be noted that, since possible excess combing action by the combing roller 2 in the intermediate carrying section B is eliminated, any excessive injury to the fibers is also prevented.

Figure 4:
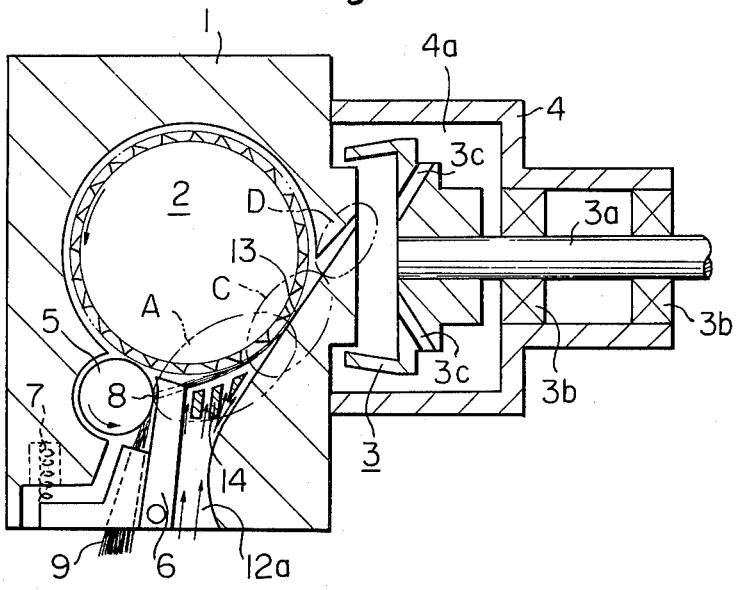
FIG. 4 is a schematic sectional view of a main part of the open-end spinning apparatus utilizing still another improved fiber separating device according to the present invention.

The apparatus shown in FIG. 4 is a modification of the apparatus shown in FIG. 3. In this embodiment, a plurality of current plates 14 for controlling the direction of the air stream are disposed within the inlet 12*a* at positions adjacent to the combing section A. Therefore, possible creation of eddy currents at a position connecting the inlet 12*a* to the combing section A of the fiber carrying passage 10 can be prevented. As a result, very effective action of separating fibers and straightening fibers in the combing section A can be expected. In this modification, a plurality of plates 14 are utilized, however, a single plate 14 for controlling the direction of air stream may be utilized to attain a control effect similar to the embodiment shown in FIG. 4. Such current plate (or plates 14) is also effective to use for the embodiment shown in FIG. 2.

In the above-mentioned three embodiments of the apparatus according to the present invention, a pneumatic means for introducing fibers separated from the nip between the feed roller 5 and the presser 6 to a part of cylindrical surface of the combing roller 2 is utilized. However, it is also effective to apply a mechanical means for more positively introducing fibers separated from the above-mentioned nip to a part of the cylindrical surface of the combing roller. The embodiments of such mechanical means are hereinafter explained in detail. Since the elements other than this mechanical means are the same as in the conventional apparatus, only the construction and function of this mechanical means is explained hereinafter.

Figure 5:
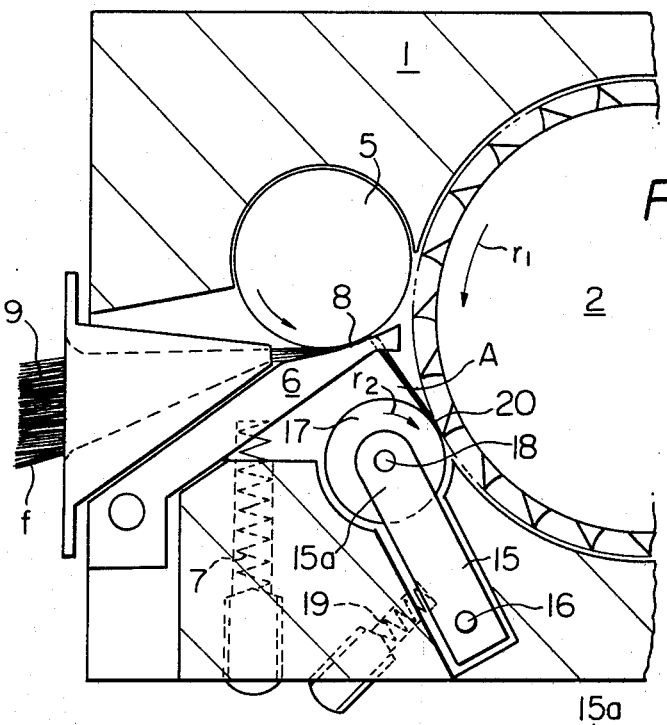
FIG. 5 is a schematic sectional view of a main part of the open-end spinning apparatus utilizing a modified fiber separating device according to the present invention.
Figure 6:
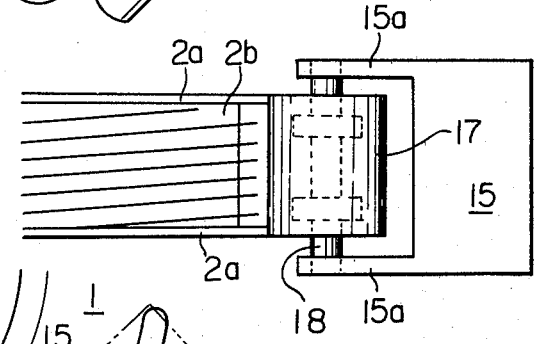
FIG. 6 is a schematic plan view of a part of the device shown in FIG. 5.

Referring to FIGS. 5 and 6, the combing section A of the fiber carrying passage 10 is radially expanded with respect to the combing roller 2 and a supporting bracket 15 is rotatably mounted on the casing 1 by means of a supporting shaft 16 at such a position that a free end of the bracket is capable of being positioned in the expanded combing section A. The supporting bracket 15 is provided with a pair of supporting arms 15*a* and an introducing roller 17 is rotatably supported by a shaft 18 mounted on the supporting arms 15*a*. Therefore, the introducing roller 17 is also positioned in the expanded combing section A. As shown in FIG. 6, the combing roller 2 is provided with a pair of flanges 2*a* and an intermediate base portion 2*b* whereon the combing wires 2*c* are formed, in such condition that the tip-points of the combing wires 2*c* do not project outside the imaginary cylindrical surface defined by the flanges 2*a* of the combing roller 2. The introducing roller 17 is provided with an axial length identical to the width of the combing roller 2.

The supporting bracket 15 is always pushed by a helical spring 19 so as to press the introducing roller 17 toward the combing roller 2 so that the roller 17 contacts the flanges 2a of the combing roller 2. Therefore, when the apparatus is driven, the combing roller 2 is rotated toward the direction represented by an arrow $r_1$ and the roller 17 is rotated toward the direction represented by an arrow $r_2$, due to the frictional contact between the roller 17 and the flanges 2a of the combing roller 2. In this embodiment, the distance between the nip 8 and a position 20 where the roller 17 contacts the flanges 2a of the combing roller 2 is so selected that this distance is substantially identical to the average staple length of the material fiber.

Next the functional feature of this embodiment is explained. When the bundle of fibers 9 passes through the nip 8, the bundle of fibers 9 receives the combing action of the combing roller 2. Since the combing section is expanded radially with respect to the combing roller 2, the individual fibers F of this bundle 9 are not injured by this combing action, because they can escape from the severe action of the combing wire. Fibers still nipped by the feed roller 5 and the presser 6 continuously receive the above-mentioned combing action. The combing action imparted to the fibers positioned at the side of the combing roller 2 tend to be stronger than the action to the other fibers. However, the introducing roller 17 positively introduces the above-mentioned other fibers to the combing roller 2 and, consequently, the difference in the combing action imparted to the fibers positioned at the side of the combing roller 2 and that of the other fiber is remarkably minimized. Since the distance between the nip 8 and the position 20 is substantially identical to the average staple length of the material fibers, there is no such serious problem, wherein the fibers still nipped by the feed roller 5 and the presser 6 receive very strong combing action so that such fibers are cut.

Since the surface speed of the roller 17 is identical to the surface speed of the flanges 2a of the combing roller 2, all fibers pass through the position 20 at substantially identical speed, so that any possible creation of hooks or entanglement of fibers can be prevented. Since the combing wires work to the fibers F in mild condition in the combing section A so that the fibers are straightened without damage. It was observed that, due to the above-mentioned desirable combing action of the combing roller 2, by utilizing the mechanical introducing means mentioned above, an excellent quality of the yarn can be expected and the operational efficiency of the open-end spinning apparatus can be attained, because of a stable spinning condition with very few yarn breakages.

Figure 7:
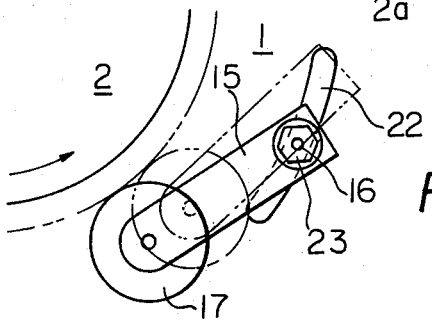
FIG. 7 is a schematic side view of a part of the device shown in FIG. 5.

The distance between the nip 8 and the position 20 in the embodiment shown in FIG. 5 can be easily changed by applying a modified device for positioning the supporting bracket 15 as shown in FIG. 7. In this modification, an arched slot 22 is formed in the casing 1 and the supporting shaft 16 is displaceably mounted in this slot 22. A fastening element, such as a nut, is fastened to the shaft 16 at any desired position in the slot 22. Therefore, when a fiber material having substantially different fiber length from the fiber material used previously is used, the distance between the nip 8 and position 20 can be easily changed so as to be correct fit for the material.

In the above-mentioned embodiment shown in FIG. 5, the roller 17 is driven by frictional contact with the flanges 2a of the combing roller 2. However, any other means for turning the roller 17, such as a positive driving mechanism, for example a gear driving mechanism which is driven by means of a power transmission such as a gearing connected to a driving shaft of the combing roller 2 or a driving shaft of the feed roller 5.

What is claimed is:

1. An improved fiber separating device disposed in a casing of an open-end spinning apparatus, comprising in combination:

a fiber-bundle supply mechanism and a spinning rotor for forming a yarn from individual fibers separated from said bundle of fibers supplied by said supply mechanism;

a combing roller rotatably disposed in said casing at a position adjacent to said fiber-bundle supply mechanism for separating said bundle of fibers into said individual fibers;

a fiber carrying passage formed in said casing at a position between said fiber-bundle supply mechanism and said spinning rotor in such a condition that a part of a cylindrical surface of said combing roller is positioned therein so that said separated individual fibers are carried through said fiber carrying passage to said spinning rotor;

said fiber carrying passage being provided with a combing section formed at an upstream position thereof, said combing section having a length substantially identical to an average fiber length of material fiber, and;

auxiliary combing means for facilitating the transfer of said individual fibers separated from said bundle of fibers to a part of the cylindrical surface of said combing roller in said combing section.

2. An improved fiber separating device according to claim 1, wherein said fiber carrying passage is provided with a stripping section for stripping individual fibers from said combing roller, a downstream section connecting said stripping section to said spinning rotor, and an intermediate carrying section formed between said combing section and said stripping section.

said auxiliary combing means comprising a pneumatic introducing means provided with an air inlet connected to said combing section so that an air stream is directed to said part of the cylindrical surface of said combing roller over the entire space of said combing section.

3. An improved fiber separating device according to claim 2, further comprising at least one air current directing plate disposed in said inlet at a position adjacent to said combing section.

4. An improved fiber separating device according to claim 1, wherein said carrying passages are provided with a stripping section for stripping fibers from said combing roller and a downstream section connecting said stripping section to said spinning rotor, said combing section and said stripping section being partly overlapped with each other, so that the distance between a position where fibers move away from said fiber-bundle supply mechanism and a position in said stripping section where fibers are separated from said combing roller is substantially identical to an average fiber length of said material fiber, said auxiliary combing means comprising a pneumatic introducing means provided with an air inlet connected to said combing section so that an air stream is directed to said part of the cylindrical surface of said combing roller over the entire space of said combing section.

5. An improved fiber separating device according to claim 4, further comprising at least one current plate disposed in said air inlet at a position adjacent to said combing section.

6. An improved fiber separating device according to claim 1, wherein said combing section of said carrying passage is radially expanded with respect to said combing roller, said combing roller is provided with a pair of flanges and an intermediate cylindrical body formed between said flanges, combing wires mounted on said cylindrical body in such a condition that the outer profile of said combing wires is positioned in the outer profile of said flanges, and wherein said auxiliary combing means comprises a supporting bracket rotatably mounted to said casing, a pressing roller rotatably mounted on said supporting bracket at a free end portion thereof in such a condition that said pressing roller is positioned in said expanded space of said combing section, a spring mounted on said casing, said spring always urging said supporting bracket so that said pressing roller is capable of contacting said flanges of said combing roller.

7. An improved fiber separating device according to claim 6, wherein the distance between a position where said fibers are separated from said fiber-bundle supply mechanism and a position were said pressing roller contacts said flanges of said combing roller is substantially identical to an average fiber length of material fiber.

8. An improved fiber separating device according to claim 7, wherein the position of said supporting bracket is capable of being changed so that some distance can be changed.

9. An improved fiber separating device according to claim 6, further comprising means for positively driving said pressing roller and means for transmitting power from the shaft of said combing roller to said positive driving means.

10. An improved fiber separating device according to claim 6, further comprising means for positively driving said pressing roller and means for transmitting power from said fiber-bundle supply mechanism to said positive driving means.

* * * * *

UNITED STATES PATENT OFFICE

CERTIFICATE OF CORRECTION

Patent No. 4,109,453 Dated August 29, 1978

Inventor(s) Akira Kobayashi, et al

It is certified that error appears in the above-identified patent and that said Letters Patent are hereby corrected as shown below:

Column 3, line 45: Before "the" insert --of--.

Column 4, line 47: "observes" should be --observed--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*